US009206598B2

(12) United States Patent
Phillips

(10) Patent No.: US 9,206,598 B2
(45) Date of Patent: Dec. 8, 2015

(54) CONSTRUCTION BLOCK LOCK

(71) Applicant: Thomas E. Phillips, Princeton, IL (US)

(72) Inventor: Thomas E. Phillips, Princeton, IL (US)

( * ) Notice: Subject to any disclaimer, the term of this patent is extended or adjusted under 35 U.S.C. 154(b) by 0 days.

(21) Appl. No.: 14/556,071

(22) Filed: Nov. 28, 2014

(65) Prior Publication Data

US 2015/0082733 A1 Mar. 26, 2015

Related U.S. Application Data

(63) Continuation-in-part of application No. 13/403,546, filed on Feb. 23, 2012, now Pat. No. 8,898,989.

(51) Int. Cl.

| | |
|---|---|
| ***E04B 1/04*** | (2006.01) |
| ***E04B 2/16*** | (2006.01) |
| *E04B 2/02* | (2006.01) |

(52) U.S. Cl.

CPC ..... *E04B 2/16* (2013.01); *E04B 2002/0243* (2013.01)

(58) Field of Classification Search

CPC .. E04F 13/072; E04F 13/0871; E04F 2203/02
USPC ..... 52/127.1, 503, 582.1, 585.1, 592.5, 52/592.6, 421, 562; 446/105, 106, 117, 446/122
See application file for complete search history.

(56) References Cited

U.S. PATENT DOCUMENTS

| | | | | |
|---|---|---|---|---|
| 1,271,447 | A * | 7/1918 | Doern | E04B 1/4185 52/562 |
| 3,312,714 | A * | 4/1967 | Eisenbraun | C07D 263/12 548/239 |
| 3,461,631 | A * | 8/1969 | Brugnola | E04B 2/18 446/122 |
| 4,091,587 | A * | 5/1978 | Depka | E04B 2/24 52/421 |
| 4,725,956 | A * | 2/1988 | Jenkins | B64C 39/024 244/190 |
| 2013/0212956 | A1 * | 8/2013 | Olaes | E04G 21/1841 52/127.1 |

* cited by examiner

*Primary Examiner* — Brian Glessner
*Assistant Examiner* — Adam Barlow

(57) ABSTRACT

The Construction Block Lock deals with a method to build block walls without the use of mortar by inserting a separate part between the bottom of a block and the top of the block it is resting on that fits the cores in the blocks locking the blocks in alignment. Assembly, disassembly and reassembly is clean and simple; essentially a stacking operation. For temporary assemblies and shipping no additional treatment would be necessary and in some cases for permanent assemblies may not be either.

1 Claim, 4 Drawing Sheets

CONSTRUCTION BLOCK LOCK

BACKGROUND OF THE INVENTION

Construction Blocks have been around a long time; they are generally made of concrete and have vertical holes extruded through them. Another common Construction Block is the brick which may or may not have holes extruded through. In general coring of these blocks to conserve material is through the top and bottom and they are connected together by applying mortar between blocks.

BRIEF SUMMARY OF THE INVENTION

The Construction Block Lock deals with a method to build block walls without the use of mortar by inserting a separate part between the bottom of a block and the top of the block it is resting on that fits the cores in the blocks holding the blocks in alignment. Assembly, disassembly and reassembly is clean and simple; essentially a stacking operation. For temporary assemblies and shipping no additional treatment other than stacking would be necessary and in some cases for permanent assemblies may not be either.

BRIEF DESCRIPTION OF THE SEVERAL VIEWS OF THE DRAWINGS

FIG. 5 shows a square block with relief for the flange 3.1 in item 3 to rest in.

DESCRIPTION OF INVENTION

The Construction Block Lock system invention is comprised of a first part, a square block cored from top to bottom with the perimeter of the core centered on the block; a second block, a two square block, that is the same as two said first blocks placed side to side and joined where they meet; and a third part, a block lock, that fits within the cored holes of top and bottom blocks, substantially snugly at the perimeter and overlapping the top surface of the bottom block so that when one block is placed on another with a block lock between the blocks are held in alignment to it and hence to each other.

Figure 1:
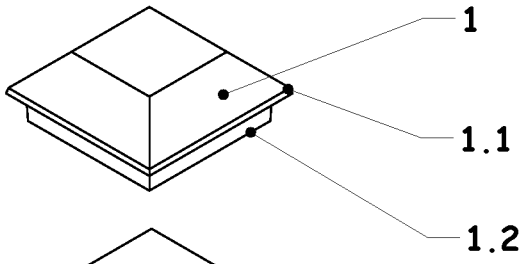
FIG. 1 shows a block lock with a pyramid shaped top.
Figure 2:
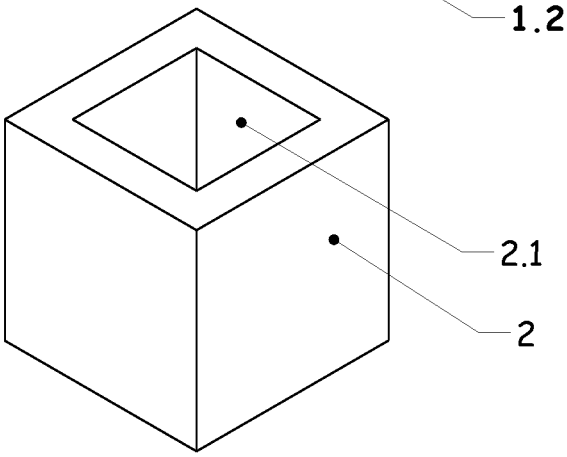
FIG. 2 shows a square construction block.
Figure 3:
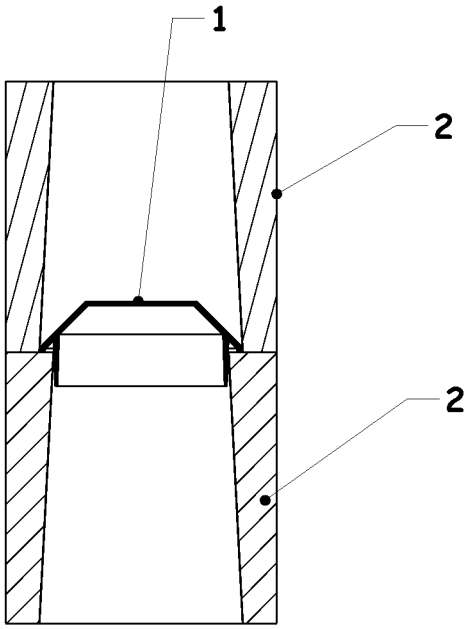
FIG. 3 is a section view that shows a square construction block with another square construction block on top of it and a block lock between them.

Referring to FIG. 1 a block lock, 1, having a truncated pyramid shaped top, with a vertical portion, 1.1, at the bottom and a vertical square shape, 1.2, at the bottom. FIG. 2 shows a square block, 2, having a square tapered hole, 2.1, extruded through it from top to bottom and FIG. 3 shows in section how two said blocks are held in alignment with respect to one another by said block lock; the vertical portion 1.1 of item 1 fitting the bottom of hole 2.1, and the vertical square shape 1.2 fitting the top of hole 2.1.

For purposes of illustration no radii are shown but those familiar with blocks will know the cores generally have radii at the corners and are tapered; the blocks pictured do have a 3 degree taper but are without radii for purposes of illustration. The block lock 1 could be made to fit tightly at the bottom profile 1.1 or at the top profile vertical portion 1.2, or both, either all around the profile or by the addition of any protrusion on the surface; this has not been shown but will be obvious to those familiar with manufacturing techniques involved. The block lock shown is a plastic molded part.

Figure 4:
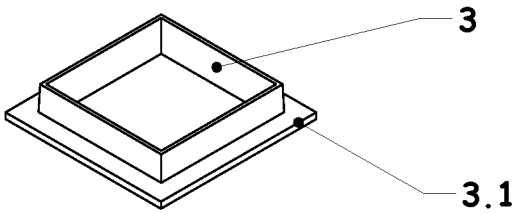
FIG. 4 shows a block lock item 3 with a square top and a flange 3.1 around it's perimeter.
Figure 5:
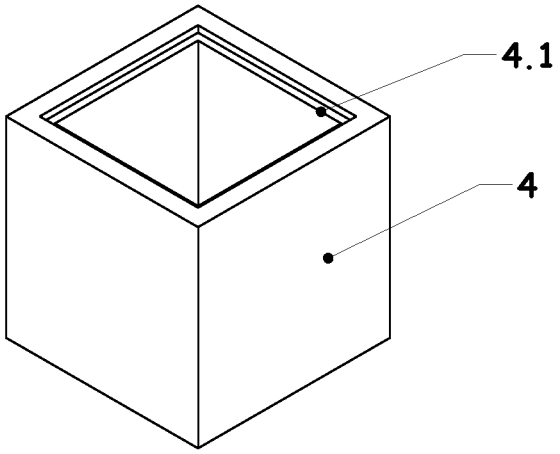
Figure 6:
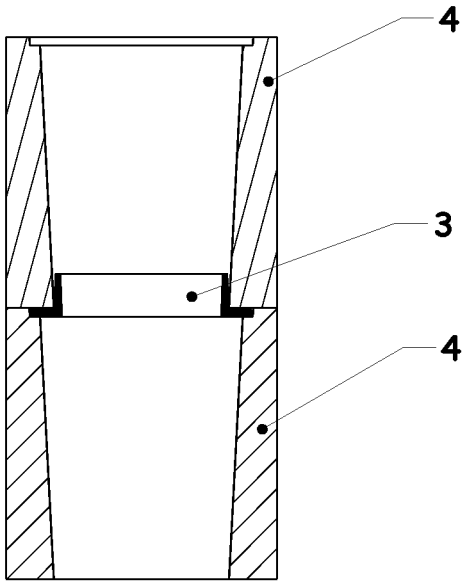
FIG. 6 is a section view showing two item 4 blocks assembled with block lock, item 3.

Referring to FIG. 4 a block lock, item 3, having a flange 3.1 is shown and referring to FIG. 5, a square block, item 4, having a relief, 4.1, provided for flange 3.1 to fit in and FIG. 6 shows in section how a block lock, item 3, fits between the top of one square block and the bottom of another and that when assembled the two blocks are held in alignment with respect to the block lock and hence to each other.

Figure 7:
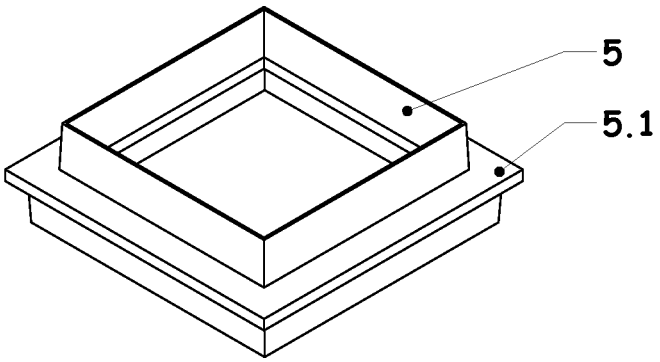
FIG. 7 shows a block lock 5 that has a flange 5.1 that is the same size square as that on the top and bottom of the block item 2.
Figure 8:
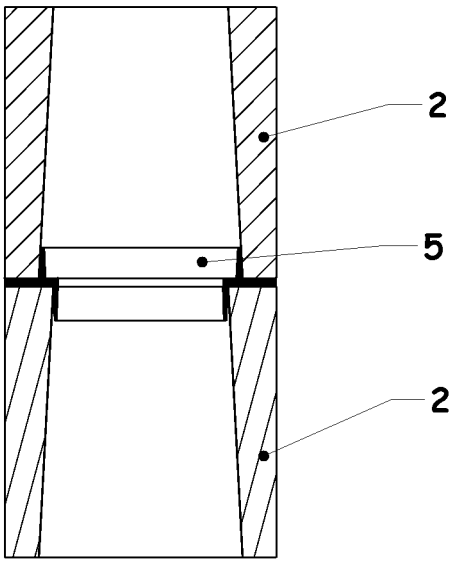
FIG. 8 is a section view showing items 5 and 2 in assembly

Referring to FIG. 7, a block lock, item 5, having a flange, 5.1, that has a square perimeter equal to that of the top of square block item 2. FIG. 8 shows in section how 2 square blocks, item 2 stacked one on another with a block lock, item 5, in between are each held in alignment with respect to said block lock and hence to each other. It is conceivable that the block lock in this configuration could be a pre form partially cured that would cure and bond to the blocks with time or the addition of water but most likely it would just be plastic.

Figure 9:
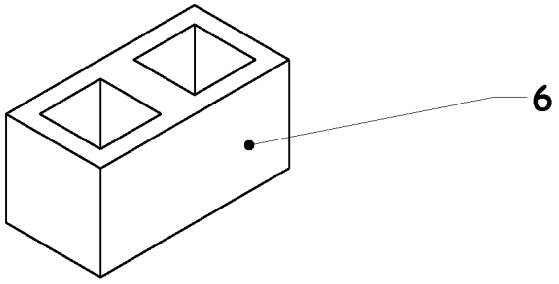
FIG. 9 shows a two square block, item 6
Figure 10:
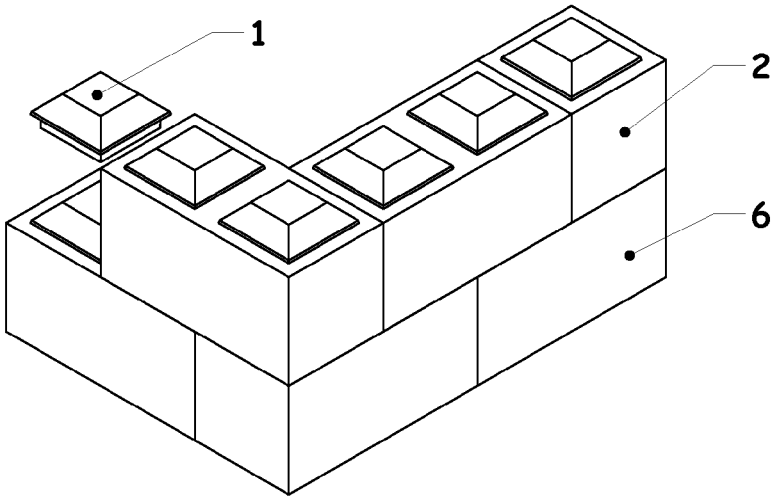
FIG. 10 is a an assembly of five, item 6, two-square blocks, and eleven, item 1, block locks and one, item 2, square block.
Figure 11:
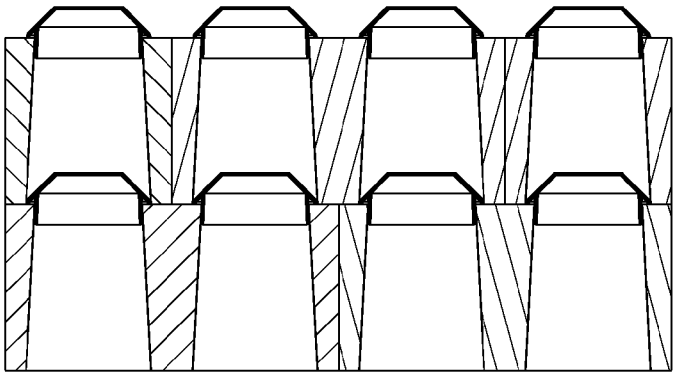
FIG. 11 is a section view of the assembly in FIG. 10 showing how components are held in alignment.

Referring to FIG. 9, a two-square block is shown, which is two square blocks joined side to side. FIG. 10 is an assembly of eleven item 1, block locks, five item 6, two-square blocks and one, item 2, square blocks and FIG. 11 is a section through the assembly in FIG. 10 showing how the blocks are held in alignment with respect to the block locks and hence to each other.

What is claimed is:

1. A set of building blocks useful for constructing walls comprised of:

a first block, which is square when seen from the top or bottom; with a square hole molded through from top to bottom; the edges of said hole being equidistant from the edges of said block's top and bottom edges respectively and further said hole is tapered from top to bottom being larger at the bottom;

and a second block, which is the same as two said first blocks joined side to side forming a block that is twice as long as said first block and having two square holes molded through from top to bottom;

and a third part, a block insert, which is a part with a top part that has a truncated pyramid shape, the base of which fits closely within the perimeter of the bottom cored area of the top block and a bottom part that fits closely within the perimeter of the top cored area of the bottom block so that when one block is stacked on another with a third part between the three parts are held in alignment with respect to one another horizontally with gravity serving as the force holding the blocks together vertically; and further a first group of three of said second blocks are laid end to end on a level surface; and at one end of this first group, a second group of three of said second blocks are laid in a direction that is perpendicular to the first group to form the first level of an L-shaped wall; and twelve block inserts are positioned in the voids on the tops of the blocks of this first level with the pyramid portion facing up; and a second L-shaped level with two cube shaped blocks and five second blocks are positioned on top of the first level, forming an L-shaped wall that is two levels high; where gravity holds the blocks together in an assembly and in alignment with the planes perpendicular and horizontal to earth and should they part a distance, which is less than the height of the truncated pyramid shapes on the top of the block inserts projecting from the blocks beneath, due to an external force, the assembly is adapted to return to it's original position.

* * * * *